US006485610B1

(12) United States Patent
Loippo

(10) Patent No.: US 6,485,610 B1
(45) Date of Patent: Nov. 26, 2002

(54) METHOD AND APPARATUS FOR THE TREATMENT OF A MATERIAL WEB AND FOR CONTROL OF THE BEHAVIOR OF A MATERIAL WEB

(75) Inventor: Kimmo Loippo, Jokihaara (FI)

(73) Assignee: Runtech Systems Oy, Kolho (FI)

( * ) Notice: Subject to any disclaimer, the term of this patent is extended or adjusted under 35 U.S.C. 154(b) by 0 days.

(21) Appl. No.: 09/577,143

(22) Filed: May 24, 2000

(30) Foreign Application Priority Data

Aug. 12, 1999 (FI) ..... 991717

(51) Int. Cl.[7] ..... D21F 7/00

(52) U.S. Cl. ..... 162/198; 162/253; 162/263; 162/306

(58) Field of Search ..... 162/115, 118, 162/121, 135, 136, 193, 197, 198, 199, 204, 206, 207, 263, 271, 272, 281, 253, 255, 381; 34/114, 117, 120; 226/7

(56) References Cited

U.S. PATENT DOCUMENTS

| | | | | | |
|---|---|---|---|---|---|
| 3,912,193 | A | * | 10/1975 | Calvaer | 242/534.1 |
| 4,087,319 | A | * | 5/1978 | Linkletter | 162/113 |
| 4,185,399 | A | * | 1/1980 | Gladish | 34/120 |
| 4,322,026 | A | * | 3/1982 | Young, Jr. | 226/15 |
| 4,602,439 | A | | 7/1986 | Eskelinen et al. | |
| 4,923,567 | A | * | 5/1990 | Liedes et al. | 162/193 |
| 4,952,145 | A | * | 8/1990 | Kwiatkowski et al. | 432/59 |
| 5,232,555 | A | * | 8/1993 | Daunais et al. | 162/193 |
| 5,571,382 | A | * | 11/1996 | Berglund | 162/198 |
| 5,718,058 | A | | 2/1998 | Atzinger | |
| 5,720,852 | A | * | 2/1998 | Virta et al. | 162/193 |
| 6,098,309 | A | * | 8/2000 | Halmschlager et al. | 34/420 |
| 6,139,638 | A | * | 10/2000 | Dubois et al. | 118/413 |
| 6,231,722 | B1 | * | 5/2001 | Vestola | 162/198 |

FOREIGN PATENT DOCUMENTS

| | | |
|---|---|---|
| EP | 0887462 | 12/1998 |
| FI | 65461 | 1/1984 |
| FI | 68279 | 4/1985 |
| FI | 93038 | 10/1994 |
| FI | 960559 | 8/1996 |

* cited by examiner

*Primary Examiner*—Peter Chin
*Assistant Examiner*—Eric Hug
(74) *Attorney, Agent, or Firm*—Birch, Stewart, Kolasch & Birch, LLP

(57) ABSTRACT

The solution of the invention relates to a method and apparatus for the treatment of a paper web in a paper or cardboard machine. The essential feature of the solution of the invention is that a moving material web (1), its properties and/or its behavior are influenced by the use of a gas (2) by causing the gas (2) to flow substantially toward the material web or to its immediate vicinity.

2 Claims, 3 Drawing Sheets

Figure 1:
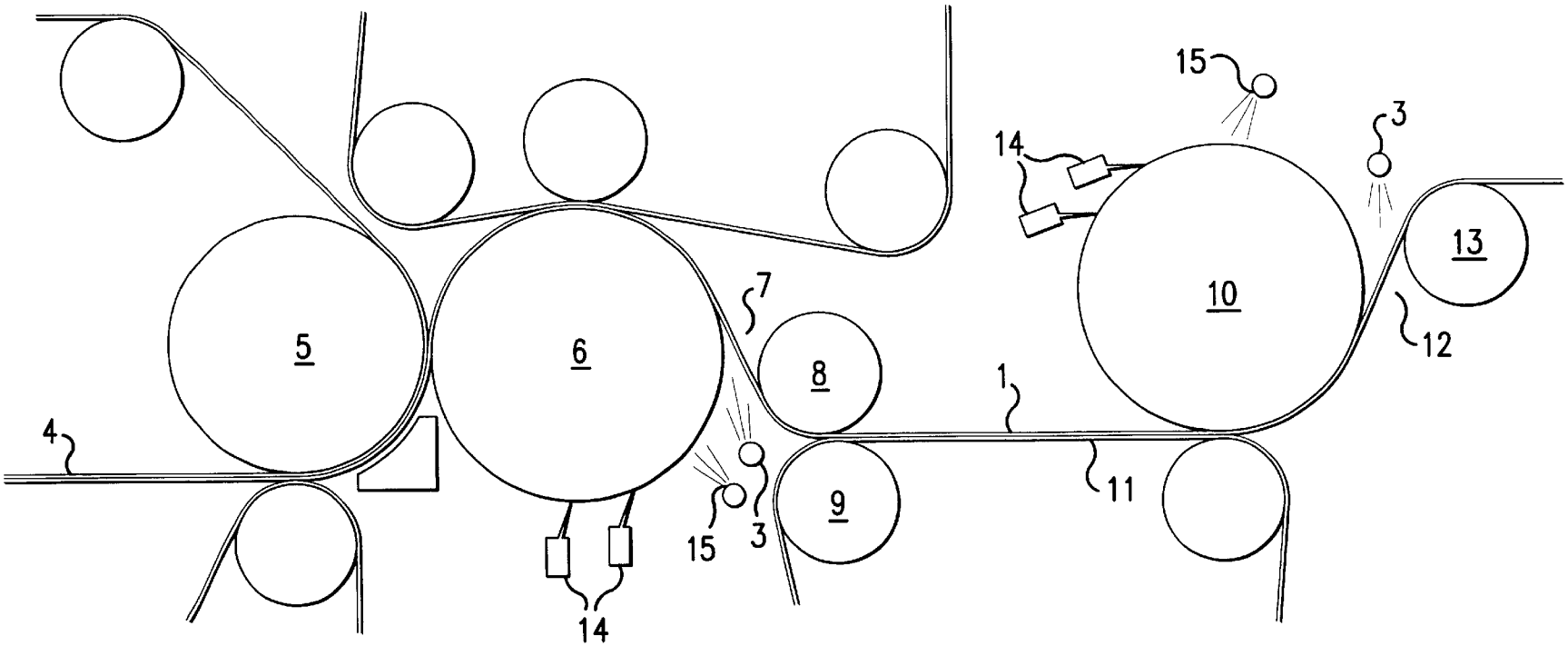

METHOD AND APPARATUS FOR THE TREATMENT OF A MATERIAL WEB AND FOR CONTROL OF THE BEHAVIOR OF A MATERIAL WEB

The present invention relates to a method for the treatment of a material web. The invention also relates to an apparatus for the treatment of a material web.

In prior art, various solutions for the treatment of a material web in a paper machine or the like are known. Commonly known is e.g. a solution in which, to help release the paper web from the middle roller in the press section of the paper machine and from the roller of the $4^{th}$ press, a releasing chemical is supplied into the jet lubricating the doctor element scraping the roller surface. This is done in the hope that some of the chemical will pass between the doctor and the roller and form a film on the roller surface. The purpose of the film formed by the chemical is to facilitate the release of the web from the roller surface e.g. by reducing or increasing the surface tension of water, depending on the composition of the chemical.

The prior-art solution has certain drawbacks. When the doctor element is working properly, it scrapes all water, dirt and possible chemicals away from the roller surface so that the roller surface after the doctor is dry and no film is left on it. The efficiency of the chemicals remains low and large amounts of them are wasted. On the other hand, if a larger amount of chemical is passed through between the doctor and the roller, this means that the scraping effect is deteriorated, which again results in web breaks and a loss in production. In prior-art supply methods, the efficiency of the chemicals remains low and the consumption of chemicals is often too high, and still no sufficient effect on the release of the paper web is achieved.

The object of the present invention is to achieve a completely new type of solution to various problems regarding the release and runnability of the material web in a paper or cardboard machine or a similar apparatus. The invention is based on a procedure in which the behavior of the material web is influenced by using a gas, such as compressed air or an equivalent medium, a particularly preferred medium being dry air. The gas is dispensed via a special gas dispensing means/device and/or element to the material web or to its immediate vicinity.

In more precise terms, the invention is characterized by what is presented in the claims.

The solution of the invention has several significant advantages. The method of the invention for dispensing gas, especially dry air, can be used in numerous applications. It can be used e.g. for improvement and control of the release of a material web, such as a paper web, from the rollers. Fluctuations occurring in the release of the web can be managed more effectively than before, thus allowing easier and more reliable release of the paper web from the roller. Therefore, only a minimal tension is needed for the release. This means that the strength properties of the paper web are not impaired as the web need not be stretched in order to release it. This also reduces the proneness of the paper machine to web breaks and increases its speed potential.

In addition, web movement e.g. in the open transfers of the paper web in the press section of the paper machine can be improved and possible problems regarding rucking up of the edges of the paper web and formation of so-called air bells in the paper web can be reduced. Moreover, the solution of the invention can be used to control and reduce the problems of slackness of the edge areas of the paper web. The above-described management and reduction of the problems of rucking up and slackness of the edges of the paper web improve the runnability of the paper machine while at the same time allowing the high paper web tension due to the above-mentioned problems to be reduced, which again reduces the proneness of the paper machine to web breaks and increases its speed potential.

In addition, the gas dispensing system of the invention can be used to influence the properties of the paper web, e.g. the uniformity of its moisture profile and dry matter content for example in the press section of the paper machine, by reducing the moistening effect on the paper web of the water jet at the doctor element on the center roll of the paper machine and increasing the temperature of the paper web by using e.g. dry heated air as the gas dispensed. The increased dry matter content of the paper web after the press section has a very great economic importance because the drying steam constitutes one of the largest individual expense items in paper manufacture.

Figure 2:
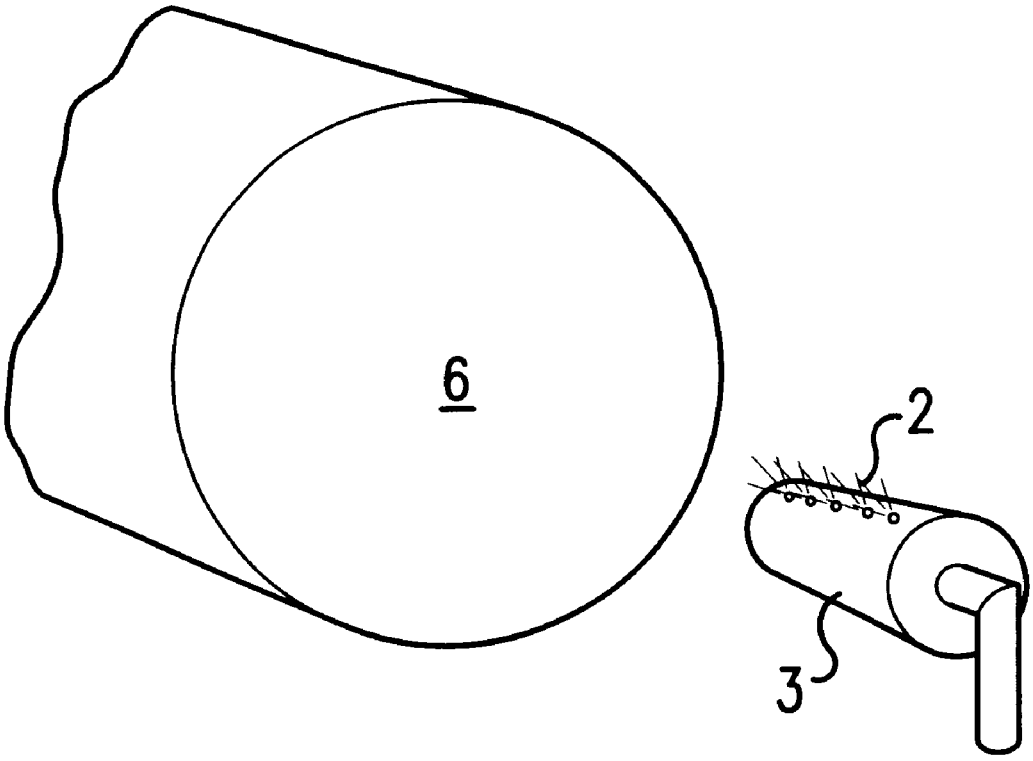
Figure 3:
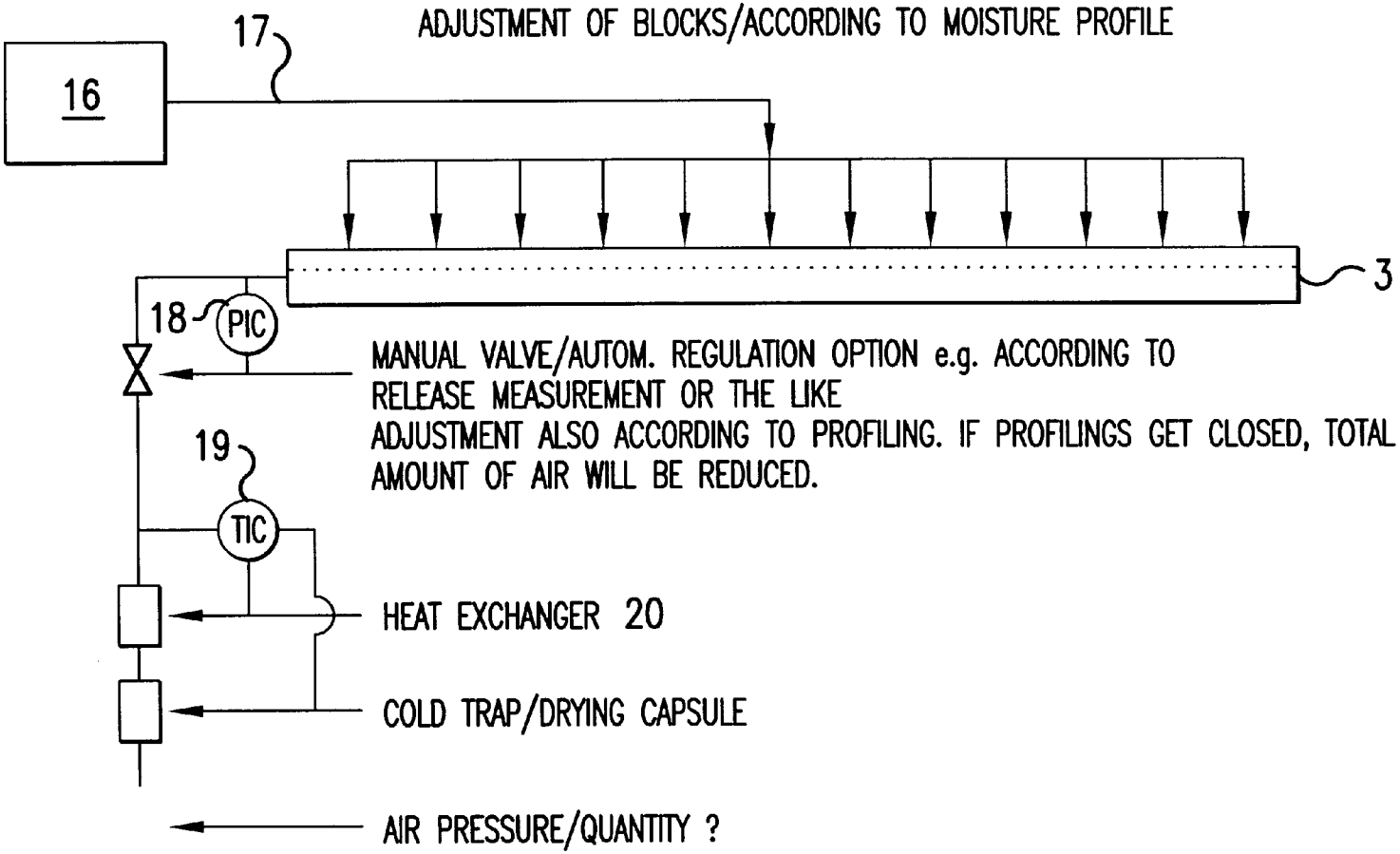

In the following, the invention will be described in detail by referring to the attached drawings, wherein FIG. 1 presents a simplified view of a press section of a paper machine FIG. 2 presents a simplified form of the solution of the invention applied to a press section as illustrated in FIG. 1, FIG. 3 presents a diagram representing a dispensing system as used in the solution of the invention.

Referring to FIG. 1, a method will be described whereby certain effects are produced on a material web and its properties as well as its behavior in a paper and cardboard machine. In the method, the moving material web 1 is subjected to the action of a gas 2, especially dry air, which is caused to flow through a special gas spreading/dispensing means and/or element 3 toward the material web or to its immediate vicinity, e.g. to the surface of a roll or fabric.

The gas 2 is used to produce an effect on at least one property of the material web 1, its runnability or on substantially corresponding factors. The gas is dispensed in a controlled manner. The passage of the material web is monitored by means of a laser distance meter, a device measuring the paper web tension or tension profile, observing the speed difference between the rollers of the paper machine or the pressure difference between the air pressures above and below the paper web, so that, based on the measurement results, the motion of the material web is influenced by controlling the dispensation of gas, its direction, amount, pressure, flow rate, composition, temperature and/or corresponding properties.

The gas dispensation serves to produce an effect on at least one of the following:

- material strength,
- release of the material web from the surface of a treatment element, such as a roll, located at or after the point of gas supply,
- adherence of the material web to the surface of a transport element, such as a felt, located at or after the point of gas supply,
- the amount of water contained in the material web, e.g. by reducing the web moistening effect of the jet water at the center roller,
- other factors impeding the runnability of the material web, e.g. the problems of waviness and rucking up of the edge areas.

If necessary, the gas supplied contains several components, in a manner corresponding e.g. to air. Moreover, advantageous additional components may be added to the gas to produce a further effect on the material web, its properties and/or its behavior.

The method and apparatus of the invention can be used e.g. in conjunction with the press section of a paper machine as illustrated in FIG. 1. The figures present a part of the press section of a paper machine. The press section illustrated in the figure comprises a so-called pick up felt 4, on whose lower surface the paper web 1 comes to the vacuum roll 5 of the press. After that, the paper web passes around the center roll 6 and across an open gap 7 via a guide roll 8 to a suction couch roll 9. After this, the web, carried by a felt 11, is passed on to further treatment, in the example illustrated to a $4^{th}$ press 10. The web is then again passed over another open gap 12 via a guide roll 13 to the drying section for further treatment. In the press illustrated in the figure, the web 1 is pressed against the vacuum roll 5, center roll 6 and the $4^{th}$ press roll, four times in all, to improve its dry matter content.

As the process water circulation system in the paper machine is becoming increasingly closed and the temperature of the paper web is rising, transferring the web across the open gaps 7 and 12 from the center roll and the $4^{th}$ press roll to the guide rolls 8 and 13 becomes more difficult. These web transfers are called release of the web from the center roll 6 and the $4^{th}$ press roll 10. In prior art, attempts have been made to facilitate the release of the web by spraying the roll surfaces with a chemical using the doctor knife lubrication jets 15. If the doctors 14 work properly, then the amount of chemical getting between the web 1 and the roll 6, 10 is insufficient to form a film that would facilitate web release. With the solution of the invention, web release can be substantially improved in spite of the problems referred to.

In an embodiment of the method of the invention according to FIG. 2, the gas dispensing/spreading means and/or element used at the center roll 6 in the press section of the paper machine is a pipeline provided with nozzles or perforations, by means of which the gas is supplied in a controlled manner to the desired point of dispensation on the web 1 or to its immediate vicinity. In addition to the press section of the paper machine, a corresponding gas dispensing/spreading element may be placed e.g. in the wire section, in the drying section, on the reeler, at the coating and sizing head.

In the following, the method will be described in detail by the aid of an example. In a case as illustrated in FIG. 1, if there are difficulties in releasing the paper web (open transfers 7 and 12) from the center roll and the $4^{th}$ press roll, the situation can be alleviated according to the invention by supplying gas using an appropriate gas dispensing/spreading element. With the solution of the invention, it is possible to fill the void formed between the web and the roll when the web is released from the roll. Because of this void, the web tends to remain seated on the roll surface through a longer distance while advancing, and therefore the web is released from the roll at a less favorable point. An expedient currently used to compensate for this phenomenon is to increase the web tension, with the result that the strength properties of the paper are impaired, the proneness of the paper machine to web breaks is increased and its speed potential is reduced. With the method of the invention, improved web release is achieved by filling the above-mentioned void with gas and/or by creating a gas mattress between the web 1 and the roll (6, 10). This reduces the tension required for the release of the web while at the same time reducing the proneness of the paper machine to web breaks and increasing its speed potential.

Moreover, the method of the invention can be used for compensating for air pressure variations occurring around the web, arising from air currents and especially affecting the release of the web from the roll. By supplying gas by means of a dispensing/spreading element as provided by the invention, sudden variations occurring in the degree of release and changes of the point of release occurring with material webs having different grammage values are reduced.

The method of the invention can also be used to reduce and control the problems of rucking up and slackness of the paper web in its edge areas by using e.g. a profiling gas dispensing/spreading element as provided by the invention, by means of which it is possible to supply gas in zones in the transverse direction of the machine to the web or to its immediate vicinity.

In addition, the method of the invention can be used for increasing the dry matter content of the web e.g. by reducing the web moistening effect of the jet water for the doctor element on the center roll. The profiling gas dispensing/spreading element of the invention can also be used to control the moisture profile of the web, e.g. by supplying dry, heated air to the web.

The invention also concerns an apparatus for the treatment of a material web, designed for the application of the method of the invention. The apparatus comprises at least one gas dispensing/spreading means and/or element 3, such as a pipeline provided with nozzles or perforations and arranged to direct and spread gas toward a moving material web 1 and/or to its immediate vicinity, e.g. to the surface of a roll or fabric.

The apparatus may comprise one or more gas dispensing/spreading means and/or equivalent elements, preferably pipelines provided with nozzles or perforations as explained above. The gas dispensing/spreading element of the invention may also be composed of several blocks controlled separately, by means of which it is possible to produce a profiling effect on the properties and behavior of the paper web.

In addition to what was said above, the gas dispensing/spreading element of the invention may consist of several separate dispensing sections, e.g. several parallel pipelines, comprising different nozzles and/or adjustable or non-adjustable nozzle elements or the like for controlling the gas flow.

The apparatus also comprises means for manipulating the state of the gas, especially air, to be dispensed, its temperature and humidity, before the delivery of the gas. For the operation of the paper machine, it is essential that the gas dispensed does not contain any water in the form of drops because water sprayed onto the web would produce holes in the paper as well as web breaks.

The apparatus of the invention may also comprise air doctor elements mounted in the immediate vicinity of the gas dispensing points or e.g. in conjunction with the gas dispensing position in the free material web transfer areas, on the opposite side of the material web in relation to the gas dispensing position. By means of the air doctor elements, it is possible to control e.g. the air pressure variations around the material web arising from air currents.

The equipment comprised in the apparatus of the invention includes means for the measurement and adjustment of the flow, temperature and pressure of the gas. Moreover, the apparatus of the invention comprises a control unit and associated software and automation. The control of the dispensation of gas, especially dry air, using the apparatus of the invention can be implemented on the basis the results of a degree of release measurement, obtained via laser distance measurement and/or on the basis of information obtained from moisture sensors and pressure and flow transducers. The control can be implemented as automatic control or as manual control, depending on the situation.

The diagram in FIG. 3 presents an embodiment of the apparatus of the invention. The apparatus comprises a gas (2) dispensing/spreading element (3), e.g. a pipeline provided with nozzles or perforations, the gas being directed from one or more holes in the pipe toward the moving paper web or to its immediate vicinity. The gas is supplied from a main gas line and/or gas container (16) into the supply line (17) of the gas dispensing/spreading element. The supply line is provided with regulating elements (18) to allow control of the pressure and flow of the gas. It is also possible to use control apparatus and software to control the regulating elements. The supply line is also provided with the required elements (19) for the adjustment of the degree of humidity of the gas. In addition, the gas supply line is provided with elements, such as a heat exchanger (20), needed for control of the gas temperature.

It is obvious to the person skilled in the art that the invention is not restricted to the examples of its embodiments described above, but that it can be varied within the scope of the following claims.

What is claimed is:

1. A method for treating a moving web and facilitating the transfer of the web between spaced successive rolls in a paper making machine wherein the web is unsupported between at least two successive rolls, the method comprising the steps of:

a) sensing at least one of (1) the motion of the web, (2) the tension of the web, (3) the moisture content of the web and (4) air pressure levels above and below the web;

b) introducing a flow of a gas onto the surface of the upstream one of the successive rolls at a location where separation of the web from the roll is intended to occur; and c) controlling, in response to the sensing performed in step a), at least one of (1) the direction of the gas flow, (2) the pressure of the gas, (3) the composition of the gas, (4) the humidity of the gas and (5) the temperature of the gas, said flow of a gas comprising a plurality of gas flows that are spaced from each other in a direction transverse to the movement of the web from roll to roll, and said controlling performed in step c) applying to each of the gas flows individually.

2. Apparatus for treating a moving web and facilitating the transfer of the web between spaced successive rolls in a paper making machine wherein the web is unsupported between at least two successive rolls, the apparatus comprising:

at least one sensor for sensing at least one of (1) the motion of the web, (2) the tension of the web, (3) the moisture content of the web and (4) air pressure levels above and below the web;

means for introducing a flow of a gas onto the surface of the upstream one of the successive rolls at a location where separation of the web from the roll is intended to occur; and means for controlling, in response to the sensing performed in step a), at least one of (1) the direction of the gas flow, (2) the pressure of the gas, (3) the composition of the gas, (4) the humidity of the gas and (5) the temperature of the gas, wherein said means for introducing a flow of gas comprises a conduit with apertures that are spaced from each other in a direction transverse to the movement of the web from roll to roll, thus providing the flow of gas with a plurality of gas flows, and wherein the means for controlling controls each of the plurality of gas flows individually.

* * * * *